United States Patent [19]

Smith et al.

[11] 4,444,123

[45] Apr. 24, 1984

[54] CURVED ROOF HOOPER CAR

[75] Inventors: Ryan M. Smith, Woodstock; David A. Stoller, Sr., Dunwoody; William B. Culler, Norcross; Paul E. Wiesner, Cumming, all of Ga.

[73] Assignee: Portec, Inc., Oak Brook, Ill.

[21] Appl. No.: 329,206

[22] Filed: Dec. 9, 1981

[51] Int. Cl.[3] ..... B61D 17/12; B61D 17/18; B61D 17/39

[52] U.S. Cl. ..... 105/377; 52/46; 52/49; 52/56; 105/248

[58] Field of Search ..... 52/45, 46, 47, 49, 50, 52/51, 52, 56; 105/247, 248, 377

[56] References Cited

U.S. PATENT DOCUMENTS

| | | | |
|---|---|---|---|
| 1,206,664 | 11/1916 | Brecht | 52/46 |
| 1,533,862 | 4/1925 | Hyle | 105/248 |
| 2,034,376 | 3/1936 | Bonsall | 52/46 |
| 2,412,283 | 12/1946 | O'Connor | 52/56 |
| 2,519,079 | 8/1950 | Shaver | 52/51 |
| 3,339,499 | 9/1967 | Charles et al. | 105/248 |
| 3,577,932 | 5/1971 | Pulcrano et al. | 105/248 |
| 4,377,058 | 5/1983 | Hallam et al. | 105/248 X |

*Primary Examiner*—Robert B. Reeves
*Assistant Examiner*—Howard Beltran
*Attorney, Agent, or Firm*—Emory L. Groff, Jr.

[57] ABSTRACT

A railway hopper car includes a curved roof having a roof sheet provided with lateral edges each joined to the top of a car side sheet by a top chord assembly. Each top chord assembly includes a top chord fully disposed within the car interior and having a vertical leg joined to the interior surface of a side sheet while an opposite inclined or angular leg is joined to the interior surface of the roof sheet. A curved cover overlies both top chord legs and forms, with the roof sheet and side sheet, a smooth continuously descending profile from the top centerline of the car roof to each of the car sides.

9 Claims, 2 Drawing Figures

CURVED ROOF HOOPER CAR

This invention relates generally to covered hopper railway cars and more particularly to an improved top chord assembly for a hopper car having a curved roof.

Covered hopper cars are provided with either flat, angular or curved roof sheets. In the case of a curved roof car, the roof comprises a sheet constructed of a fixed radius of curvature having its opposite lateral edges extending to the area adjacent the top of the car side sheets. Structure must be provided to adequately attach and support the components of the car in this area and usually comprise a chord member extending the length of the car. Such a chord assembly should provide sufficient rigidity to the car body without interfering with the handling of bulk lading and preferably facilitates the installation of the car lining while eliminating potential lining crack precipitators.

Many prior top chord assemblies in covered hopper cars have included beams presenting an exposed shelf or edge located on the exterior of the car, which arrangement produces a catch basin serving to collect lading residue upon the loading of the car. This earlier structure obviously produces several disadvantages. If spilled lading is allowed to remain collected upon the roof and top chord, this lading residue is wasted and subsequently contaminates the right of way during transit of the car. Additionally, any remaining residual lading of a reactive nature can accelerate deterioration of the roof and other car structure. On the other hand, with many existing structures, excessive time and labor would be involved to physically remove this lading residue before the car is moved from the loading station.

By the present invention, an improved arrangement is provided wherein a particularly configured top chord comprises two legs respectively joined to the lateral edge of the roof sheet and the top portion of the car side sheet. Overlying an exterior cavity formed by the top chord is a cover element constructed of a thickness substantially comparable to that of the roof sheet and side sheets. This cover element comprises a smoothly curved center section joined to opposite flanges flushly aligned with the respective lateral edge of the roof sheet and top portion of a side sheet such that a smooth, continuously descending profile is formed by the roof sheet, cover element and side sheet. In this manner, during loading of the hopper car, lading residue spilling upon the top surface of the roof sheet is easily automatically discharged from the car thereby enhancing the usable life span of the car roof since reactive lading compositions are not retained or entrapped upon the car roof and/or top chord structure.

Accordingly, one of the objects of the present invention is to provide an improved curved roof hopper car having a top chord joining each roof sheet lateral edge to a side sheet with a curved cover element overlying a portion of the top chord and forming a smooth, continuous profile descending from the outer surface of the roof sheet to the vertically disposed side sheet.

Another object of the present invention is to provide an improved curved roof hopper car including a top chord joining the interior surfaces of adjacent roof and side sheets, with the chord provided with a pair of adjacent offset portions each having an angular leg respectfully attached to the roof and side sheets.

A further object of the present invention is to provide an improved curved roof hopper car including a top chord assembly joining adjacent edges of the roof sheet and side sheets and including an angular leg attached to the interior surface of the roof sheet and the inner surface of a cover element flange, together with a vertical leg flushly joining the top portion of a side sheet and another flange of the cover element.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawing.

Figure 1:
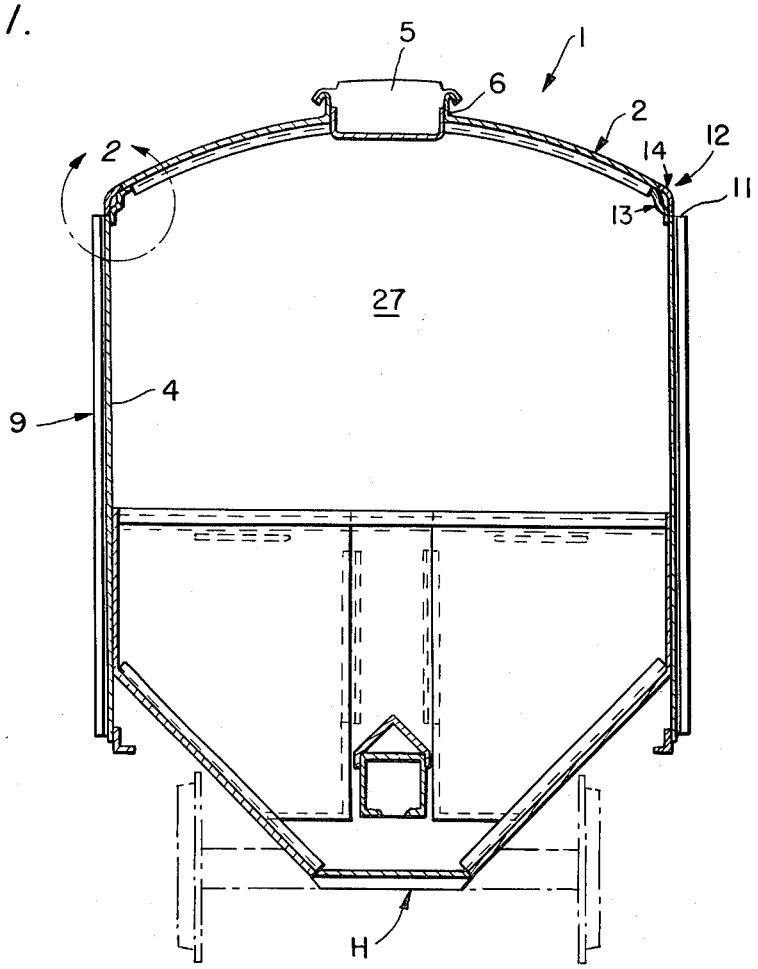
FIG. 1 is a transverse sectional view through a typical curved roof hopper car and illustrates the top chord assembly of the invention.

Referring now to the drawing, particularly FIG. 1, the present invention will be seen to relate to a curved roof covered hopper car, generally designated 1. The lowest point of the car body will be understood to include appropriate hopper means of any suitable construction in the area H. The roof sheet 2 preferably comprises a constant radius member expanding the top of the car 1 and provided with two parallel lateral edges 3—3 terminating short of the vertical plane defined by the two side sheets 4—4. A plurality of hatch openings 5 are provided along the car centerline through the roof sheet 2, each including well known coaming 6. With this arrangement, the hatch openings 5 are disposed at the highest point of the car and although this feature is common to all covered hopper cars, only with a curved roof is the optimal car capacity obtained due to the angle of repose characteristic of materials commonly carried. This curved roof sheet 2, coupled with the top chord assembly to be described hereinafter, insures the maximum self-discharge of spilled lading atop the car.

Figure 2:
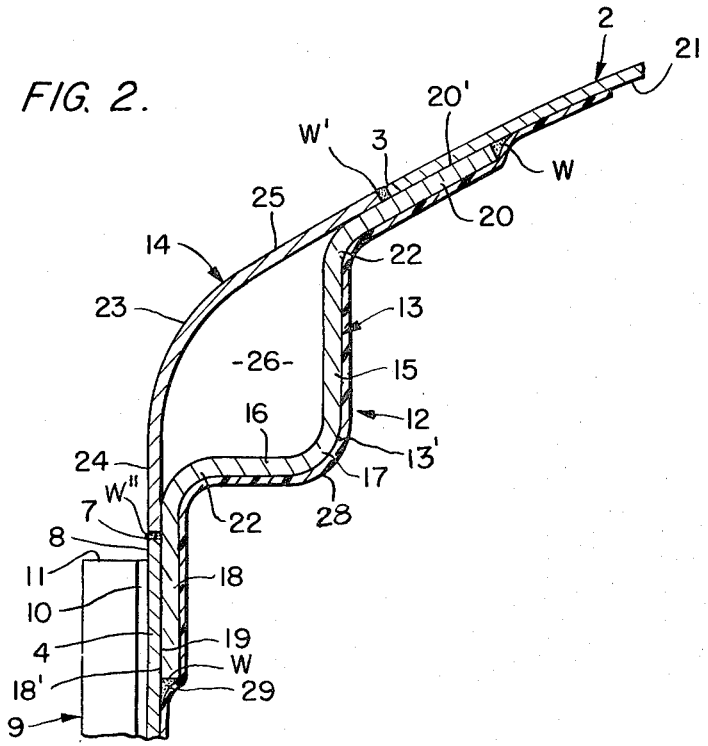
FIG. 2 is an enlarged fragmentary sectional view of the encircled area of FIG. 1.

As shown most clearly in FIG. 2 of the drawings, each side sheet 4 preferably comprises a vertical planar member having a horizontally disposed top portion or edge 7 located at a point substantially below the plane of the roof sheet lateral edge 3. The exterior surface 8 of the side sheets are suitably reinforced by means of a plurality of vertically disposed, laterally spaced apart side posts 9 which may comprise any well known configuration such as channel members having opposite flanges 10 affixed to the side sheet exterior surfaces 8. The top portion 7 of each side sheet preferably extends slightly above the top 11 of the side posts as shown in FIG. 2.

A top chord assembly, generally designated 12, is employed to provide both the required rigidity in the area adjacent the car side and the roof lateral edges and also to form a smooth continuously descending external profile between the juxtaposed roof sheet and side sheets. This assembly 12 includes a top chord 13 and a cooperating cover element 14 each comprising a unitary structural member extending substantially the length of the car 1. The top chord 13 will be seen to include a vertical offset portion 15 joined to a right angularly disposed horizontal offset portion 16 by means of a smoothly curved juncture 17. Extending from the outer portion of the horizontal offset portion 16 is a downwardly disposed vertical side sheet leg 18 which is suitably affixed, such as by rivets or welding, to the interior surface 19 of the top portion 7 of the side sheet 4. The outer end of the chord vertical offset portion 15 in turn is joined to an angular, inclined roof sheet leg 20 which is likewise suitably attached to the interior surface 21 of the roof sheet 2 such as by rivets or welding. Fillet welds W—W are shown providing the above described attachment. As in the case of the relatively large radius of curved juncture 17, the two legs 18 and 20 of the top chord are similarly joined to their respective offset portions 16 and 15 by means of a relatively large radius juncture 22.

It is important to note that during the assembly of each top chord 13 to the respective side sheet and roof sheet lateral edge, that only a portion of the outer surfaces 18' and 20' of the two legs is covered by the respective side and roof sheets. Thus, it will follow that the lateral edge 3 of the roof sheet as well as the top portion 7 of the side sheet are each spaced from the adjacent top chord junctures 22—22 such that a portion of the two outer surfaces 18' and 20' remain exposed. These exposed surfaces provide a mounting for the cover element 14 which will be seen to include a smoothly curved center section 23 bounded by an opposite side flange 24 and roof flange 25. With the two flanges 24–25 tangent to the ends of the curved center section 23, a smooth continuous profile of the cover element is assured.

The cover element 14 is installed by overlying the roof flange 25 atop the exposed outer surface 20' of the chord roof sheet leg 20 while the cover element side flange 24 is positioned in overlying relationship to the outer surface 18' of the chord side sheet leg 18. When thusly positioned, the cover element 14 is appropriately affixed to the top chord such as by rivets or welding whereupon the top chord cavity 26 formed by the chord offset portions 15 and 16 becomes fully enclosed. Continuous weld seams W'–W" are added between the cover element flanges 25–24 and the roof sheet lateral edge 3 and side sheet top portion 7 to insure that no lading is entrapped between the cover 14 and the adjacent roof sheet and side sheet.

As shown most clearly in FIG. 2 of the drawing, the thickness of the cover element 14 is substantially comparable to that of the roof sheet 2 as well as the side sheet 4 such that a smooth, abutment-free continuity is provided between these components and the resulting flush disposition offers a smooth continuous profile constantly descending from the top centerline of the car roof to the vertically disposed side sheets. The thickness of the material comprising the top chord 13 will, of course, be determined by the structural requirements calculated during the design of the car 1 and in most cases, will be formed of a thicker material than the cooperating components of the car. With the above described construction, it will be apparent that the smooth continuous external profile is in no way affected by use of thick material for the top chord 13.

Depending upon the top of lading intended to be conveyed within the interior 27 of the car 1, appropriate lining material is installed upon the interior surface 19 of the side sheets 4, the inner surface 13' of the top chord and the interior surface 21 of the roof sheet. As shown in FIG. 2, this lining 28 may comprise a layer or coating of urethane or an epoxy base that usually is applied by spraying and is preferably applied to all interior surfaces that could come in contact with the lading such that a smooth clean interior profile is provided and which additionally, enhances the complete discharge of all lading from within the car interior 27. The projection of the top chord offset portions into the car interior likewise facilitates full discharge of lading from within the car in the top corner areas with the relatively large radius of the junctures 22 discouraging retention of fine-particle lading in these areas.

We claim:

1. A covered hopper car including, substantially vertically disposed side sheets each having a top edge, a roof sheet provided with centrally disposed hatch openings, said roof sheet extending outwardly and downwardly from said hatch openings and having opposite lateral edges spaced above and inwardly of said side sheet top edges, a top chord assembly spanning each spaced apart side sheet and roof sheet edge, each said top chord assembly comprising an outer cover element and an inner top chord, said top chord including a vertical side sheet leg and an opposite angular roof sheet leg, said top chord provided with a pair of offset portions substantially normal to one another and respectively joined to said angular leg and vertical leg, a smoothly curved juncture between said pair of offset portions and between each said offset portion and respective leg, said vertical leg flushly joined in an overlying manner to the interior surface of said side sheet adjacent said top edge, said angular leg flushly joined in an overlying manner to the interior surface of said roof sheet adjacent said lateral edge, said cover element including a curved configuration having opposite roof and side flanges, said outer cover element including a curved center section intermediate said roof and side flanges, said roof and side flanges substantially co-planar with and abutting said roof sheet lateral edge and side sheet top edge respectively, said roof flange overlying said top chord angular leg juxtaposed said roof sheet lateral edge and said side flange overlying said vertical leg juxtaposed said side sheet top edge whereby a smooth continuously descending exterior profile is defined by said cover element from said roof sheet adjacent said hatch openings to said side sheets.

2. A covered hopper car according to claim 1 wherein, said roof sheet, cover element and side sheet are of substantially equal thickness.

3. A covered hopper car according to claim 1 wherein, said flanges are substantially straight.

4. A covered hopper car according to claim 1 wherein, said pair of offset portions comprise a horizontal portion joined to said vertical leg and a vertical portion joined to said angular leg.

5. A covered hopper car according to claim 1 wherein, said flanges are tangent to said curved center-section.

6. A covered hopper car according to claim 1 wherein, said roof sheet is curved in cross-section.

7. A covered hopper car according to claim 6 wherein, said roof sheet curvature defines a substantially constant radius between said lateral edges.

8. A covered hopper car according to claim 1 including, a disparate lining covering the interior of said roof sheet, top chord and side sheet.

9. A covered hopper car according to claim 8 wherein, said lining comprises a plastic composition.

* * * * *

UNITED STATES PATENT AND TRADEMARK OFFICE

CERTIFICATE OF CORRECTION

PATENT NO. : 4,444,123

DATED : April 24, 1984

INVENTOR(S) : Ryan M. Smith, David A. Stoller, Sr., William B. Culler and Paul E. Wiesner It is certified that error appears in the above-identified patent and that said Letters Patent are hereby corrected as shown below:

On the title page, the title should read:

-[54] Curved Roof Hopper Car --.

Signed and Sealed this

*Thirtieth* Day of *October 1984*

[SEAL]

*Attest:*

GERALD J. MOSSINGHOFF

*Attesting Officer*

*Commissioner of Patents and Trademarks*